US012428802B2

(12) United States Patent
Takaki et al.

(10) Patent No.: US 12,428,802 B2
(45) Date of Patent: Sep. 30, 2025

(54) WORK VEHICLE

(71) Applicant: Kubota Corporation, Osaka (JP)

(72) Inventors: Satoshi Takaki, Sakai (JP); Takahiro Usami, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 506 days.

(21) Appl. No.: 17/994,389

(22) Filed: Nov. 28, 2022

(65) Prior Publication Data

US 2023/0235527 A1 Jul. 27, 2023

(30) Foreign Application Priority Data

Jan. 27, 2022 (JP) ..... 2022-011088

(51) Int. Cl.
*E02F 3/42* (2006.01)
*E02F 9/08* (2006.01)
*E02F 3/34* (2006.01)

(52) U.S. Cl.
CPC ..... *E02F 3/422* (2013.01); *E02F 3/427* (2013.01); *E02F 9/085* (2013.01); *E02F 3/3414* (2013.01)

(58) Field of Classification Search
CPC ..... E02F 3/422; E02F 3/427; E02F 3/3414; E02F 9/085
USPC ..... 414/715
See application file for complete search history.

(56) References Cited

FOREIGN PATENT DOCUMENTS

JP 2010-065482 3/2010

OTHER PUBLICATIONS

Japanese Office Action for corresponding JP Application No. 2022-011088, Feb. 18, 2025 (w/ machine translation).
Decision to Grant a Patent for corresponding JP Application No. 2022-011088, Apr. 15, 2025 (w/ machine translation).

*Primary Examiner* — Ronald P Jarrett
(74) *Attorney, Agent, or Firm* — MORI & WARD, LLP

(57) ABSTRACT

A work vehicle includes an arm cylinder configured to raise an arm assembly. A front plate is attached to a vehicle body frame in front of the arm cylinder. A back plate is attached to the vehicle body frame in back of the arm cylinder. A side plate is attached to the front plate and the back plate opposite to the vehicle body frame with respect to the arm cylinder. A bottom plate is attached to the vehicle body frame and the side frame below the arm cylinder. The front plate extends in a reference direction in which the arm cylinder is directed when a work equipment attached to the arm assembly is grounded. The bottom plate includes a downward extending portion extending in the reference direction. The downward extending portion, the front plate, the side plate, and the vehicle body frame define an opening below the arm cylinder.

20 Claims, 4 Drawing Sheets

WORK VEHICLE

CROSS-REFERENCE TO RELATED APPLICATIONS

The present application claims priority under 35 U. S. C. § 119 to Japanese Patent Application No. 2022-011088, filed Jan. 27, 2022. The contents of this application are incorporated herein by reference in their entirety.

BACKGROUND OF THE INVENTION

Field of the Invention

The present invention relates to a work vehicle.

Discussion of the Background

Japanese Unexamined Patent Publication No. 2010-065482 discloses a work vehicle in which an arm cylinder is mounted in a lower closed space surrounded by an outer wall, an inner wall, a rear connecting wall, and a mounting plate of an air frame.

SUMMARY OF THE INVENTION

According to one aspect of the present invention, a work vehicle includes a vehicle body frame, an arm assembly, an arm cylinder, a front plate, a back plate, a side plate, and a bottom plate. The vehicle body frame has a front-back direction, a lateral direction perpendicular to the front-back direction, and a height direction perpendicular to the front-back direction and the lateral direction. The arm assembly is attached to the vehicle body frame to be rotatable about a first rotational axis extending in the lateral direction. The arm cylinder is attached to the vehicle body frame to be rotatable about a second rotational axis substantially parallel to the first rotational axis. The arm cylinder is configured to control raising and lowering of the arm assembly in the height direction. The front plate is attached to the vehicle body frame in front of the arm cylinder in the front-back direction. The back plate is attached to the vehicle body frame in back of the arm cylinder in the front-back direction. The side plate is attached to the front plate and the back plate opposite to the vehicle body frame with respect to in the lateral direction. The bottom plate is attached to the vehicle body frame and the side frame below the arm cylinder in the height direction. The vehicle body frame, the front plate, the back plate and the side plate surround the arm cylinder. The front plate extends in a reference direction in which the arm cylinder is directed when a work equipment attached to the arm assembly is grounded. The bottom plate includes a downward extending portion extending in the reference direction below the second rotational axis in the height direction. The downward extending portion, the front plate, the side plate and the vehicle body frame define an opening below the arm cylinder.

According to another aspect of the present invention, a work vehicle includes a vehicle body frame, an arm assembly, an arm cylinder, a front plate, a back plate, a side plate, and a bottom plate. The vehicle body frame has a front-back direction, a lateral direction perpendicular to the front-back direction, and a height direction perpendicular to the front-back direction and the lateral direction. The arm assembly is attached to the vehicle body frame to be rotatable about a first rotational axis extending in the lateral direction. The arm cylinder is attached to the vehicle body frame to be rotatable about a second rotational axis substantially parallel to the first rotational axis to control raising and lowering of the arm assembly in the height direction. The front plate is attached to the vehicle body frame in front of the arm cylinder in the front-back direction. The back plate is attached to the vehicle body frame in back of the arm cylinder in the front-back direction. The side plate is attached to the front plate and the back plate opposite to the vehicle body frame with respect to the arm cylinder in the lateral direction. The bottom plate is attached to the vehicle body frame and the side frame below the arm cylinder in the height direction. The vehicle body frame, the front plate, the back plate, and the side plate surround the arm cylinder. The front plate extends in a reference direction in which the arm cylinder is directed when a work equipment attached to the arm assembly is grounded. The straight line connecting front ends of the arm cylinder directed in the reference direction to extend in the reference direction is defined as a first straight line, the front ends having heights from the second rotational axis in the height direction that are different from each other. The straight line connecting back ends of the arm cylinder directed in the reference direction to extend in the reference direction is defined as a second straight line, the back ends having heights from the second rotational axis in the height direction that are different from each other. A front end of the bottom plate in the front-back direction is provided between the first straight line and the second straight line in a cylinder width direction perpendicular to the reference direction and the lateral direction, as viewed in the lateral direction. The front end of the bottom plate, the front plate, the side plate, and the vehicle body frame defining an opening below the arm cylinder in the height direction.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings.

DESCRIPTION OF THE EMBODIMENTS

Figure 1:
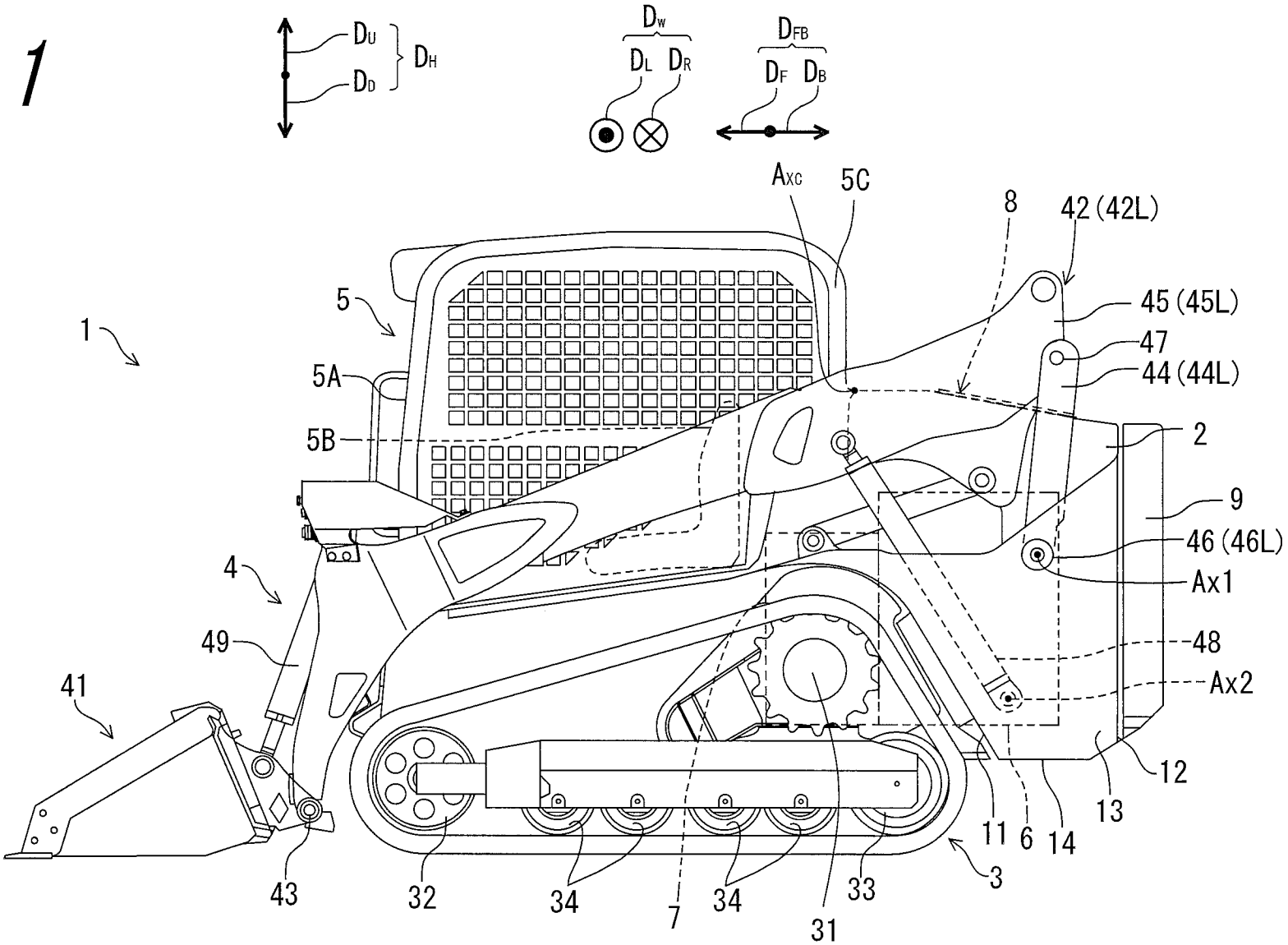
FIG. 1 is a side view of a work vehicle.

Hereinafter, the present invention will be described in detail with reference to drawings showing embodiments thereof. In the drawings, the same reference numerals indicate corresponding or substantially identical configurations.

EXEMPLARY EMBODIMENT

<Overall Configuration>

Figure 2:
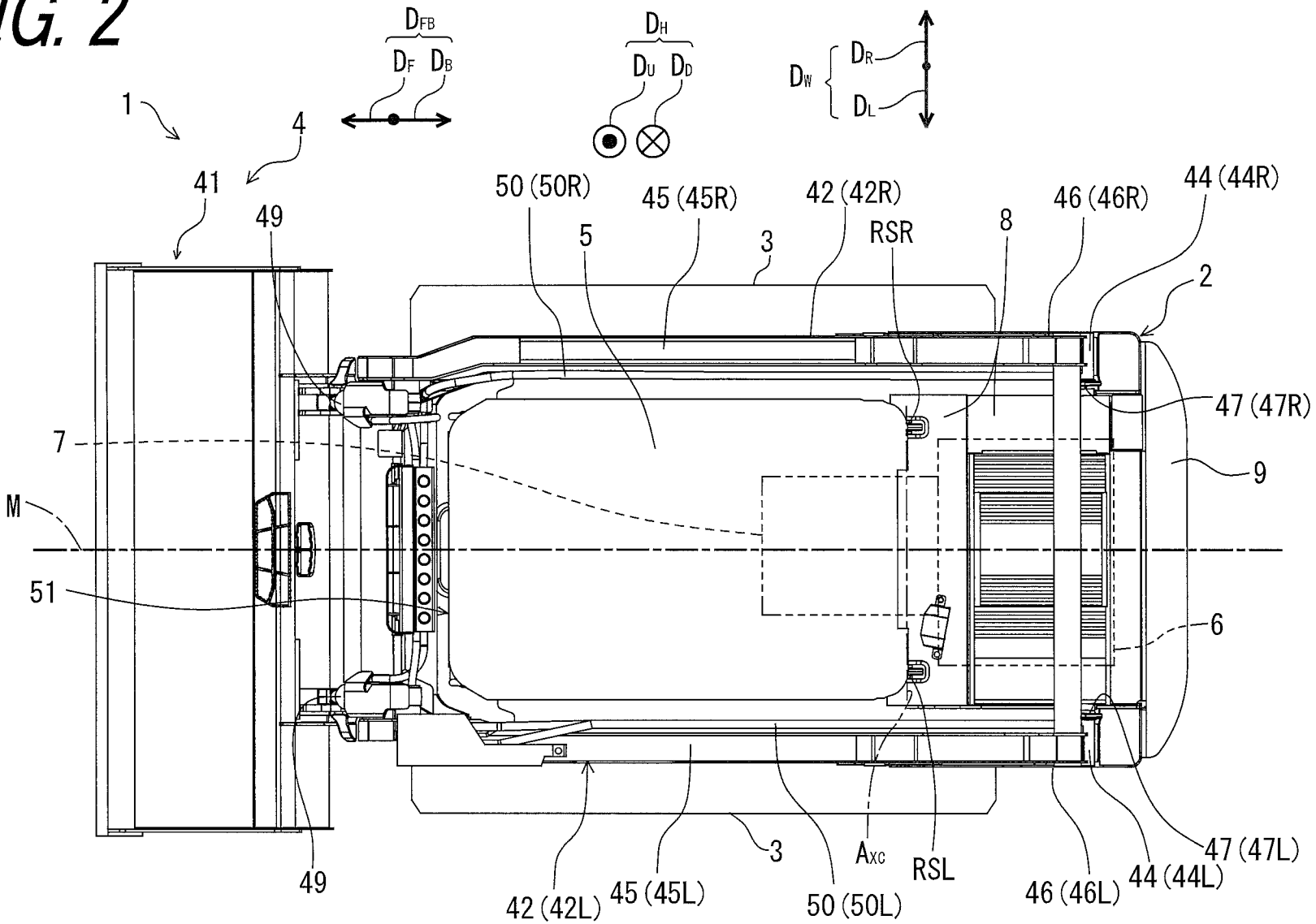
FIG. 2 is a top view of a work vehicle.

Referring to FIGS. 1 and 2, a work vehicle 1, for example, a compact truck loader, includes a vehicle body frame 2, a traveling device 3, a working device 4, and a cabin 5. The vehicle body frame 2 supports the traveling device 3, the working device 4, and the cabin 5. In the illustrated embodiment, the traveling device 3 is a crawler type traveling device. Therefore, the traveling device 3 includes a drive wheel 31, driven wheels 32, 33, and rolling wheels 34. However, the traveling device 3 is not limited to a crawler type traveling device. The traveling device 3 may be, for example, a front wheel/rear wheel traveling device, or a traveling device having a front wheel and a rear crawler. The working device 4 includes work equipment bucket 41 at the distal end of working device 4. A proximal end of the working device 4 is attached to a rear portion of the vehicle body frame 2. The working device 4 includes a pair of arm assemblies 42 for rotatably supporting the bucket 41 via the bucket pivot shaft 43. A pair of arm assembly 42 has a lift link 44 and a lift link 44 respectively.

The lift link 44 is rotatable around a fulcrum shaft 46 with respect to the vehicle body frame 2. In the following embodiments, the center axis of the fulcrum shaft 46 is referred to the first rotational axis Ax1. The arm assembly 42 is attached to the vehicle body frame 2 so as to be rotatable about a first rotational axis Ax1. The arm 45 is rotatable with respect to the lift link 44 about the joint shaft 47. The working device 4 includes a plurality of arm cylinders 48 and at least one equipment cylinder 49. Each of the plurality of arm cylinders 48 is connected to the vehicle body frame 2 and the arm 45 so as to be rotatable about a second rotational axis, and is configured to move the lift link 44 and the arm 45 so as to raise and lower the arm assembly 42 and the bucket 41 up and down in a height direction $D_H$ described later. At least one equipment cylinder 49 is configured to tilt the bucket 41. The cabin 5 is attached to a front portion of the vehicle body frame 2. A work vehicle 1 is provided with a window 5A in front of a cabin 5, and a driver's seat 5B and an operating device (not illustrated) in the cabin 5. The cabin frame 5C shown in FIG. 1 forming the outer shell of the cabin 5 is rotatable about rotational shafts RSL and RSR on the vehicle body frame 2 shown in FIG. 2. FIGS. 1 and 2 illustrate a common rotational axis AXC defined by rotational axes RSL and RSR.

It should be noted that, in the embodiment according to the present application, the front-back direction $D_{FB}$ (forward $D_F$/rearward $D_B$) means a front-back direction (front/rear direction) as seen from an operator sitting on the driver's seat 5B of the cabin 5. Lateral direction $D_W$ (left direction DL/right direction $D_R$) means a lateral direction (left direction/right direction) as viewed from the operator. Height direction $D_H$ (upward $D_U$/downward $D_D$) means the height direction (upward/downward) as seen from the operator. The front-back, lateral, and vertical (height) directions of the work vehicle 1 coincide with the front-back, lateral, and vertical (height) directions as viewed from the operator. In other words, the vehicle body frame 2 has a front-back direction $D_{FB}$, a lateral direction $D_W$ perpendicular to the front-back direction $D_{FB}$, and a height direction $D_H$ perpendicular to the front-back direction $D_{FB}$ and the lateral direction $D_W$.

FIG. 1 shows the left side of the work vehicle 1. As shown in FIG. 2, the vehicle body frame 2 is substantially symmetrical with respect to the vehicle body center plane M, and among the pair of arm assemblies 42, the arm assembly 42 provided on the left side with respect to the vehicle body center plane M is shown as a first arm assembly 42L, and the arm assembly 42 provided on the right side with respect to the vehicle body center plane M is shown as a second arm assembly 42R. A lift link 44 provided on the left side with respect to the vehicle body center plane M is shown as a first link 44L. A lift link 44 provided on the right side with respect to the vehicle body center plane M is shown as a second link 44R. An arm 45 provided on the left side with respect to the vehicle body center plane M is shown as a first arm 45L, and an arm 45 provided on the right side with respect to the vehicle body center plane M is shown as a second arm 45R. A fulcrum shaft 46F provided on the left side of the vehicle body center plane M is a first fulcrum shaft 46L, and a fulcrum shaft 46 provided on the right side with respect to the vehicle body center plane M is shown as a second fulcrum shaft 46R. A joint shaft 47 provided on the left side with respect to the vehicle body center plane M is shown as a first joint shaft 47L, and a joint shaft 47 provided on the right side with respect to the vehicle body center plane M is shown as a second joint shaft 47R.

Referring to FIGS. 1 and 2, the work vehicle 1 further includes an engine 6 provided at a rear portion of the vehicle body frame 2. The engine 6 is configured to provide driving force to the traveling device 3 and the working device 4. The engine 6 is provided between a pair of arm assemblies 42 in the lateral direction $D_W$ of the work vehicle 1. The work vehicle 1 further includes a bonnet cover 8 for covering the engine 6. The work vehicle 1 further includes a rear bonnet cover 9 provided at the back end of the vehicle body frame 2. The rear bonnet cover 9 is openable and closable such that a maintenance worker can perform maintenance work on the engine 6 and the like.

Referring to FIG. 1, an engine 6 is connected to a hydraulic pump 7 which is driven by the engine 6 and supplies hydraulic fluid. The hydraulic pump 7 includes a traveling hydraulic pump for supplying hydraulic fluid to a hydraulic motor for driving a drive wheel 31, and a working hydraulic pump for supplying hydraulic fluid to a plurality of arm cylinders 48 and at least one equipment cylinder 49.

Figure 3:
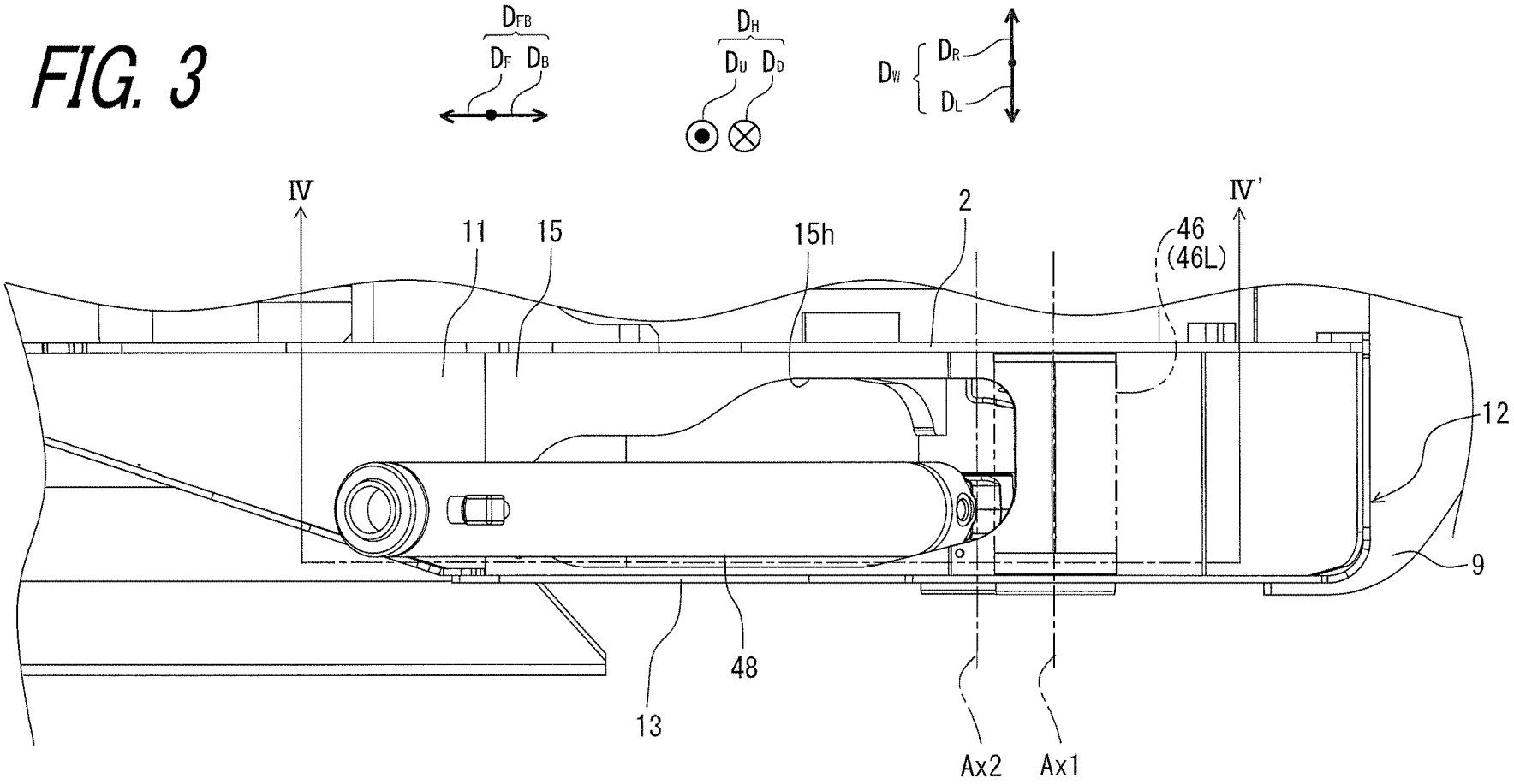
FIG. 3 is an enlarged view of the periphery of the arm cylinder as viewed from above.
Figure 4:
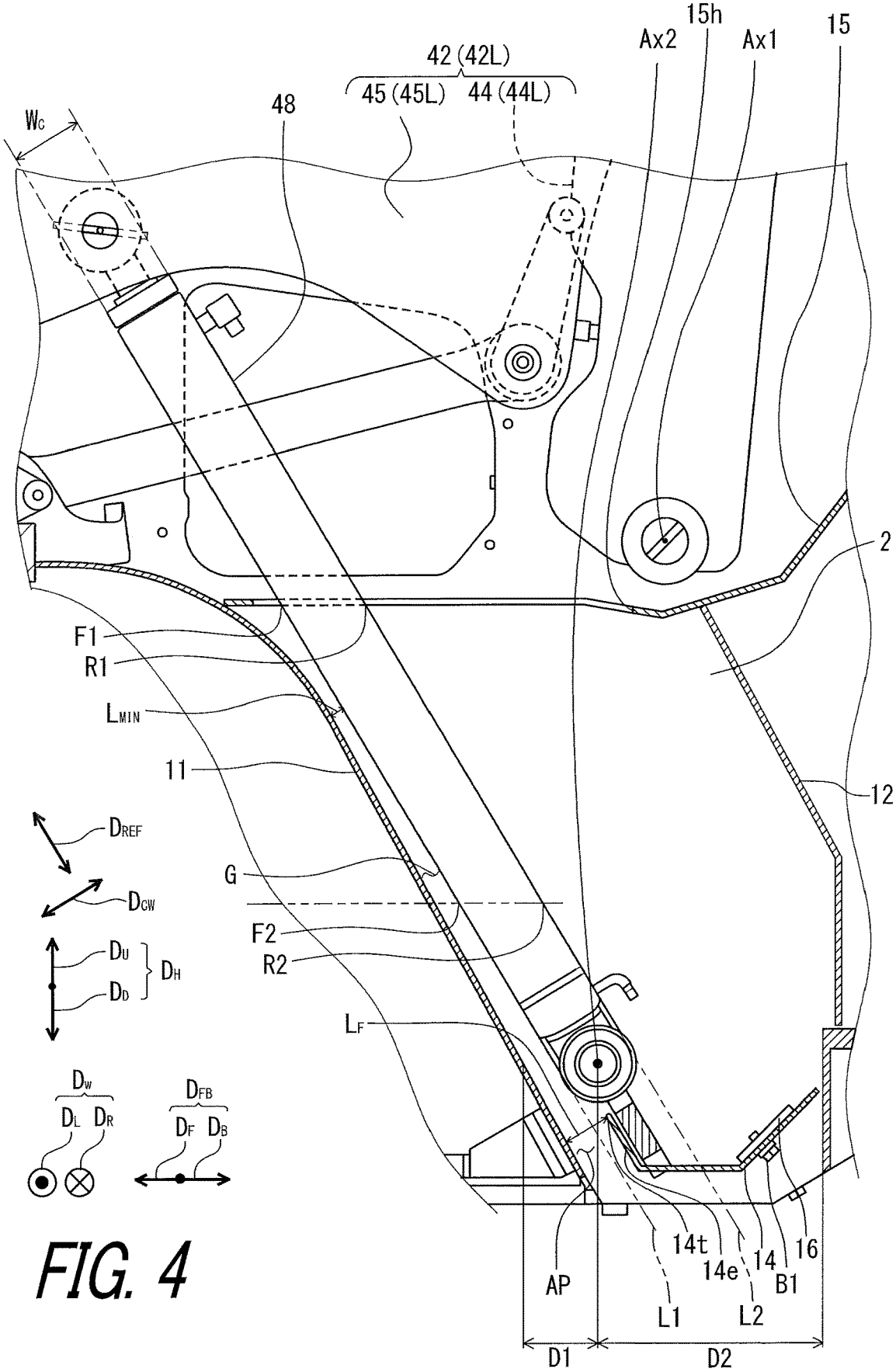
FIG. 4 is a cross-sectional view taken along the cross-sectional line IV-IV' of FIG. 3.

FIG. 3 is an enlarged view of the periphery of the arm cylinder 48 as viewed from above. FIG. 3 illustrates an arm cylinder 48 provided on the left side with respect to the vehicle body center plane M. The structure around the arm cylinder 48 provided on the right side with respect to the vehicle body center plane M is substantially symmetrical with the structure shown in FIG. 3 with respect to the vehicle body center plane M. In FIG. 3, illustration of the arm assembly 42 above the arm cylinder 48 is omitted for convenience of explanation of the structure around the arm cylinder 48. However, the fulcrum shaft 46 (first fulcrum shaft 46L) is illustrated by a two-dot chain line. Referring to FIG. 3, the first rotational axis Ax1 extends in the lateral direction $D_W$. The second rotational axis Ax2 is substantially parallel to the first rotational axis Ax1. FIG. 4 is a sectional view taken along the cut line IV-IV' of FIG. 3. In FIG. 4, the arm assembly 42 above the arm cylinder 48 is also shown. In FIG. 4, the side plate 13 is not shown.

Referring to FIGS. 1, 3 and 4, a work vehicle 1 includes a front plate 11, a back plate 12, a side plate 13, a bottom plate 14 and a cover 15. The front plate 11 is attached to the vehicle body frame 2 in front of ($D_F$) the arm cylinder 48 in the front-back direction $D_{FB}$. The back plate 12 is attached to the vehicle body frame 2 in back of ($D_B$) the arm cylinder 48 in the front-back direction $D_{FB}$. The side plate 13 is attached to the front plate 11 and the back plate 12 opposite to the vehicle body frame 2 with respect to the arm cylinder 48 in the lateral direction $D_W$. The bottom plate 14 is attached to the vehicle body frame 2 and the side plate 13 below ($D_D$) the arm cylinder 48 in the height direction $D_H$. The vehicle body frame 2, the front plate 11, the back plate 12, the side plate 13 and the bottom plate 14 surround the arm cylinder 48 and form a housing space for housing the arm cylinder 48. The cover 15 is connected to the vehicle body frame 2, the front plate 11, the back plate 12, and the side plate 13 above ($D_U$) the bottom plate 14 in the height direction $D_H$. The cover 15 has a through hole 15*h* through which the arm cylinder 48 passes. The through hole 15*h* has such a shape and size that it does not interfere with the movement of the arm cylinder 48. The cover 15 prevents dust from entering the accommodation space from above.

Referring to FIG. 4, the front plate 11 extends in a reference direction $D_{REF}$ which the arm cylinder 48 faces when the work equipment (bucket 41) attached to the arm assembly 42 contacts the ground. The first distance D1 between the second rotational axis Ax2 and the front plate 11 in the front-back direction $D_{FB}$ is shorter than the second distance D2 between the second rotational axis Ax2 and the back plate 12 in the front-back direction $D_{FB}$. More specifically, when the arm cylinder 48 is directed in the reference direction $D_{REF}$, a straight line formed by connecting a plurality of front ends 14*t* (for example, F1, F2) of the arm cylinder 48 having a plurality of heights from the second rotational axis Ax2 in the height direction $D_H$ is defined as a first straight line L1. When the arm cylinder 48 is directed in the reference direction $D_{REF}$, a straight line extending in the reference direction $D_{REF}$ a straight line formed by connecting a plurality of back ends (for example, R1 and R2) of the arm cylinder 48 having a plurality of heights from the second rotational axis Ax2 in the height direction $D_H$ is defined as a second straight line L2. The minimum distance $L_{MIN}$ in the cylinder width direction $D_{CW}$ perpendicular to the reference direction $D_{REF}$ and the lateral direction $D_W$ between the front plate 11 and the first straight line L1 is short. Therefore, the gap G between the arm cylinder 48 and the front plate 11 is easily clogged with dust that has entered through the through hole 15*h*. Note that the minimum distance $L_{MIN}$ is shorter than the width Wc of the arm cylinder 48 in the cylinder width direction $D_{CW}$.

However, the front end 14*t* of the bottom plate 14 in the front-back direction $D_{FB}$, the front plate 11, the side plate 13, and the vehicle body frame 2 define an opening AP below the arm cylinder 48. When viewed in the lateral direction $D_W$, the front end 14*t* of the bottom plate 14 is located between the first straight line L1 and the second straight line L2 in the cylinder width direction $D_{CW}$ perpendicular to the reference direction $D_{REF}$ and the lateral direction $D_W$. The distance LF in the cylinder width direction $D_{CW}$ between the front end 14*t* of the bottom plate 14 and the front plate 11 is longer than the minimum distance $L_{MIN}$ in the cylinder width direction $D_{CW}$ between the front plate 11 and the first straight line L1. As a result, the dust stuck in the gap G is easily discharged from the opening AP.

Further, referring to FIG. 4, the bottom plate 14 has a downward extending portion 14*e* extending in the reference direction $D_{REF}$ in the lower $D_D$ of the height direction $D_H$ than the second rotational axis Ax2. As seen in the lateral direction $D_W$, the downward extending portion 14*e* is located between the first straight line L1 and the second straight line L2 in the cylinder width direction $D_{CW}$ perpendicular to the reference direction $D_{REF}$ and the lateral direction $D_W$. The downward extending portion 14*e*, the front plate 11, the side plate 13, and the vehicle body frame 2 form an opening AP below ($D_D$) the arm cylinder 48. The minimum distance LF in the cylinder width direction $D_{CW}$ between the downward extending portion 14*e* and the front plate 11 is longer than the minimum distance $L_{MIN}$ in the cylinder width direction $D_{CW}$ between the front plate 11 and the first straight line L1. As a result, the dust stuck in the gap G is easily discharged from the opening AP. Further, since the opening AP is formed as a space surrounded by the plates inclined backward with respect to each other, it is possible to prevent shrubs, grass, and the like from intruding from the accommodation space from below $D_D$ of the opening AP.

The bottom plate 14 is detachable from the vehicle body frame 2 and the side plate 13. More specifically, the work vehicle 1 further includes a mounting plate 16 connected to the vehicle body frame 2 and having a plate shape. The bottom plate 14 is configured to be attached to the mounting plate 16. The mounting plate 16 is inclined frontward ($D_F$) in the front-back direction $D_{FB}$. More specifically, the mounting plate 16 is attached to the vehicle body frame 2 by welding, and the bottom plate 14 is attached to the mounting plate 16 by bolts B1. The work vehicle 1 may include a mounting plate 16 similar to the mounting plate 16 connected to the side plate 13. As a result, dust deposited on the bottom plate 14 can be removed by removing the bottom plate 14, so that cleaning becomes easy. Further, since the mounting plate 16 is inclined frontward ($D_F$) in the front-back direction $D_{FB}$, the dust on the mounting plate 16 is removed together with the removal of the bottom plate 14, thereby facilitating the cleaning.

OPERATION AND EFFECT OF THE EMBODIMENTS

A work vehicle 1 has an opening AP formed by a downward extending portion 14*e* (a front end 14*t* of a bottom plate 14), a front plate 11, a side plate 13, and a vehicle body frame 2 below ($D_D$) an arm cylinder 48. As a result, the arm cylinder 48 is prevented from being damaged, and dust is prevented from entering the accommodation space accommodating the arm cylinder 48 from below.

MODIFIED EXAMPLE

In the embodiment described above, the arm assembly 42 includes two members, the lift link 44 and the arm 45. However, the arm assembly 42 may consist of only one member or three or more links.

As used herein, "comprising" and its derivatives are non-limiting terms that describe the presence of a component, and do not exclude the presence of other components not described. This also applies to "having", "including" and their derivatives.

The terms "member," "part," "element," "body," and "structure" may have multiple meanings, such as a single part or multiple parts.

Ordinal numbers such as "first" and "second" are simply terms used to identify configurations and do not have other meanings (e.g., a particular order). For example, the presence of the "first element" does not imply the presence of the "second element", and the presence of the "second element" does not imply the presence of the "first element".

Terms such as "substantially", "about", and "approximately" indicating degrees can mean reasonable deviations such that the final result is not significantly altered, unless otherwise stated in the embodiments. All numerical values described herein may be interpreted to include words such as "substantially," "about," and "approximately."

In the present application, the phrase "at least one of A and B" should be interpreted to include only A, only B, and both A and B.

In view of the above disclosure, it will be apparent that various changes and modifications of the present invention are possible. Therefore, the present invention may be carried out by a method different from the specific disclosure of the present application without departing from the spirit of the present invention.

What is claimed is:

1. A work vehicle comprising:

a vehicle body frame having a front-back direction, a lateral direction perpendicular to the front-back direction, and a height direction perpendicular to the front-back direction and the lateral direction;

an arm assembly attached to the vehicle body frame to be rotatable about a first rotational axis extending in the lateral direction;

an arm cylinder attached to the vehicle body frame to be rotatable around a second rotational axis substantially parallel to the first rotational axis to control raising and lowering of the arm assembly in the height direction;

a front plate attached to the vehicle body frame in front of the arm cylinder in the front-back direction;

a back plate attached to the vehicle body frame in back of the arm cylinder in the front-back direction;

a side plate attached to the front plate and the back plate opposite to the vehicle body frame with respect to the arm cylinder in the lateral direction;

a bottom plate attached to the vehicle body frame and the side plate below the arm cylinder in the height direction;

the vehicle body frame, the front plate, the back plate and the side plate surrounding the arm cylinder;

the front plate extending in a reference direction in which the arm cylinder is directed when a work equipment attached to the arm assembly is grounded;

the bottom plate including a downward extending portion extending in the reference direction below the second rotational axis in the height direction; and the downward extending portion, the front plate, the side plate, and the vehicle body frame defining an opening below the arm cylinder.

2. The work vehicle according to claim 1, wherein a straight line connecting front ends of the arm cylinder directed in the reference direction to extend in the reference direction is defined as a first straight line, the front ends having heights from the second rotational axis in the height direction that are different from each other, wherein a straight line connecting back ends of the arm cylinder directed in the reference direction to extend in the reference direction is defined as a second straight line, the back ends having heights from the second rotational axis in the height direction that are different from each other, and wherein the downward extending portion is provided between the first straight line and the second straight line in a cylinder width direction perpendicular to the reference direction and the lateral direction, as viewed in the lateral direction.

3. The work vehicle according to claim 2, wherein a first distance between the second rotational axis and the front plate in the front-back direction is shorter than a second distance between the second rotational axis and the back plate in the front-back direction.

4. The work vehicle according to claim 2, wherein a minimum distance between the front plate and the first straight line in the cylinder width direction is shorter than a width of the arm cylinder in the cylinder width direction.

5. The work vehicle according to claim 4, wherein a minimum distance between the downward extending portion and the front plate in the cylinder width direction is longer than a minimum distance between the front plate and the first straight line in the cylinder width direction.

6. The work vehicle according to claim 2, wherein the bottom plate is detachable from the side plate and the vehicle body frame.

7. The work vehicle according to claim 6, further comprising:

a mounting plate connected to the vehicle body frame having a plate shape, wherein the bottom plate is configured to be attached to the mounting plate, and the mounting plate is inclined frontward in the front-back direction.

8. The work vehicle according to claim 7, further comprising:

a cover connected to the vehicle body frame, the front plate, the back plate, and the side plate above the bottom plate in the height direction, wherein the cover has a through hole through which the arm cylinder passes.

9. The work vehicle according to claim 2, further comprising:

a cover connected to the vehicle body frame, the front plate, the back plate, and the side plate above the bottom plate in the height direction, wherein the cover has a through hole through which the arm cylinder passes.

10. The work vehicle according to claim 1, wherein a first distance between the second rotational axis and the front plate in the front-back direction is shorter than a second distance between the second rotational axis and the back plate in the front-back direction.

11. The work vehicle according to claim 1, wherein the bottom plate is detachable from the side plate and the vehicle body frame.

12. The work vehicle according to claim 11, further comprising:

a mounting plate connected to the vehicle body frame having a plate shape, wherein the bottom plate is configured to be attached to the mounting plate, and the mounting plate is inclined frontward in the front-back direction.

13. The work vehicle according to claim 1, further comprising:

a cover connected to the vehicle body frame, the front plate, the back plate, and the side plate above the bottom plate in the height direction, wherein the cover has a through hole through which the arm cylinder passes.

14. A work vehicle comprising:

a vehicle body frame having a front-back direction, a lateral direction perpendicular to the front-back direction, and a height direction perpendicular to the front-back direction and the lateral direction;

an arm assembly attached to the vehicle body frame to be rotatable about a first rotational axis extending in the lateral direction;

an arm cylinder attached to the vehicle body frame to be rotatable about a second rotational axis substantially parallel to the first rotational axis to control raising and lowering of the arm assembly in the height direction;

a front plate attached to the vehicle body frame in front of the arm cylinder in the front-back direction;

a back plate attached to the vehicle body frame in back of the arm cylinder in the front-back direction;

a side plate attached to the front plate and the back plate opposite to the vehicle body frame with respect to the arm cylinder in the lateral direction; and a bottom plate attached to the vehicle body frame and the side plate below the arm cylinder in the height direction;

the vehicle body frame the front plate, the back plate, and the side plate surrounding the arm cylinder;

the front plate extending in a reference direction in which the arm cylinder is directed when a work equipment attached to the arm assembly is grounded;

a straight line connecting front ends of the arm cylinder directed in the reference direction to extend in the reference direction being defined as a first straight line, the front ends having heights from the second rotational axis in the height direction that are different from each other;

a straight line connecting back ends of the arm cylinder directed in the reference direction to extend in the reference direction being defined as a second straight line, the back ends having heights from the second rotational axis in the height direction that are different from each other;

a front end of the bottom plate in the front-back direction being provided between the first straight line and the second straight line in a cylinder width direction perpendicular to the reference direction and the lateral direction, as viewed in the lateral direction; and the front end of the bottom plate, the front plate, the side plate, and the vehicle body frame defining an opening below the arm cylinder in the height direction.

15. The work vehicle according to claim 14, wherein a first distance between the second rotational axis and the front plate in the front-back direction is shorter than a second distance between the second rotational axis and the back plate in the front-back direction.

16. The work vehicle according to claim 14, wherein a minimum distance between the front plate and the first straight line in the cylinder width direction is shorter than a width of the arm cylinder in the cylinder width direction.

17. The work vehicle according to claim 16, wherein a distance between the front end of the bottom plate and the front plate in the cylinder width direction is longer than a minimum distance between the front plate and the first straight line in the cylinder width direction.

18. The work vehicle according to claim 14, wherein the bottom plate is detachable from the side plate and the vehicle body frame.

19. The work vehicle according to claim 18, further comprising:

a mounting plate connected to the vehicle body frame having a plate shape, wherein the bottom plate is configured to be attached to the mounting plate, and the mounting plate is inclined frontward in the front-back direction.

20. The work vehicle according to claim 14, further comprising:

a cover connected to the vehicle body frame, the front plate, the back plate, and the side plate above the bottom plate in the height direction, wherein the cover has a through hole through which the arm cylinder passes.

* * * * *